United States Patent [19]

Pierson et al.

[11] Patent Number: 4,880,040

[45] Date of Patent: Nov. 14, 1989

[54] LIQUID PETROLEUM CONFINEMENT SYSTEM

[76] Inventors: Raymond Pierson, 512 Mail Creek Ct., Fort Collins, Colo. 80525; William Whiteley, Box 1722, Guymon, Okla. 73942

[21] Appl. No.: 245,817

[22] Filed: Sep. 16, 1988

[51] Int. Cl.[4] ..... B67C 3/00; E21B 43/34

[52] U.S. Cl. ..... 141/5; 141/37; 166/267; 55/55

[58] Field of Search ..... 166/75.1, 267, 265, 166/244.1; 141/1, 4, 5, 37, 47, 248, 285, 301, 302, 305; 208/340; 210/188, 218, 257.1; 55/55

[56] References Cited

U.S. PATENT DOCUMENTS

| | | | |
|---|---|---|---|
| 345,586 | 7/1886 | Hall | 166/267 |
| 1,396,632 | 11/1921 | Jensen | 55/55 |
| 1,419,880 | 6/1922 | Mauclere | 141/37 |
| 2,937,140 | 5/1960 | Stinson | 208/340 |
| 4,093,544 | 6/1978 | Ross | 210/257.1 |

*Primary Examiner*—Henry J. Recla
*Assistant Examiner*—J. Casimer Jacyna
*Attorney, Agent, or Firm*—Limbach, Limbach & Sutton

[57] ABSTRACT

A method for collecting and maintaining oil at elevated pressures eliminates the undesirable discharge of volatile components to the atmosphere. At least two tanks are interconnected by a valved liquid inlet manifold and a valved gas outlet. While one tank is being filled with pressurized petroleum, the second tank is in valved vapor communication with the first tank and both tanks are isolated from atmosphere. This configuration permits the filling and storage of the first tank at pressures above atmospheric. When the first tank is full to capacity, the inlet manifold directs liquid into the second tank. Before unloading the first tank to a tank truck or pipeline, any excess vapor pressure is vented to the atmosphere. The process is repeated by introducing the second tank to an emptied first tank.

1 Claim, 1 Drawing Sheet

LIQUID PETROLEUM CONFINEMENT SYSTEM

TECHNICAL FIELD

The present invention relates generally to the collection, storage and distribution of petroleum products containing pressurized gas in storage tanks, and more specifically relates to the use of two storage tanks in vapor-phase communication to reduce the time during which the petroleum products are exposed to atmospheric conditions.

BACKGROUND OF THE INVENTION

Petroleum is a naturally occurring, complex mixture of hydrocarbons which can exist as solid, liquid or gas depending upon the chemical composition of the petroleum and the temperature and pressure at which the petroleum is confined. Since petroleum is often found in geological formations located at great depths from the earth's surface, it normally contains components which are liquid at the temperatures and pressures existing in the source geological formation, but which components become vapor phase at normal atmospheric conditions existing at the earth's surface.

The most widely used indicator of a crude petroleum's economic value to the producer is its API (American Petroleum Institute) gravity. This indicator is a measure of an oil's density, which is dependent upon its chemical composition, and is also related to specific gravity. Normally, the price which a producer receives for her crude oil depends on its gravity, the less dense oils (higher API gravity) being the most valuable. This price schedule is based on the premise that the lighter oils contain higher percentages of the more desirable products such as gasoline. It is possible that a particular 30° oil may be more valuable than a 20' oil due to a particularly high yield of a desirable product.

As noted above, the surface or "stock tank oil" as finally sold by the producer is not the same liquid which existed in the underground formation from which the petroleum was extracted. The differences between stock tank oil (at the surface) and reservoir oil (underground) are of fundamental importance in understanding the problem and the usefulness of the present invention.

A reservoir oil always contains in solution some components which would become gases at standard temperature and pressure, i.e., 44.7 PSIA and 60° F. The solubility of these gases is due to the elevated pressure and temperature existing at their underground conditions. As the crude oil is produced, brought from the underground reservoir to the earth's surface by either natural or mechanical means, the pressure is decreased until it reaches substantially atmospheric conditions in the stock tanks. This pressure reduction causes certain physical changes in the reservoir fluid properties. Some of the volatile fractions vaporize, causing the liquid volume to shrink, the liquid viscosity to increase, and the API gravity of the crude oil to decrease.

Crude oil, once stored at the surface in atmospheric stock tanks, undergoes a physical change due in part to its chemical composition but more so due to pressure and temperature conditions. When a liquid petroleum is placed in an open container (a container that exposes the liquid to atmospheric conditions), it slowly escapes into the gas phase, eventually leaving the container empty. This is due to the fact that atmospheric pressure is less than the vapor pressures of the major constituents of the crude oil.

Since the physical stat of the crude oil observed when its constituents are vaporizing is in the form of gas, it becomes necessary to apply Boyle's Law; "At constant temperature, the product of the volume and pressure of a given amount of gas is a constant. PxV=constant." In general, the volume of a given quantity of gas at constant temperature is inversely proportional to the pressure. This law when combined with Charles Law and Avogadro's hypothesis can be combined into the "Ideal-Gas Equation", PV=nRT; where P=pressure, V=volume, n=the number of moles of gas, R=Proportionality constant, and T=temperature. The equation expresses a quantitative relationship between all four of the quantities that could possibly be varied in describing the state of gas.

Since the produced crude oil is stored at the surface of the earth at individual, separate well sites having atmospheric stock tanks, it becomes subjected to many changes in relation to the PV=nRT equation. It must be realized that the atmospheric conditions constantly change with respect to any one given geographical location, due to changes in the atmospheric pressures caused by high and low pressure areas that constantly are moving, cold fronts, warm fronts, humidity, solar intensity, the Jet Stream, season of the year, the location of the crude oil storage in relation to the equator, the ground level elevation with respect to sea level, etc. Natural atmospheric conditions are constantly changing and thereby directly effect the vaporization rate of the major constituents of the crude oil. Any change in pressure, volume or temperature with respect to the crude oil at the constantly changing conditions under which it is stored causes a loss of the crude oil to the atmosphere. This loss has been observed to range from 10–30% of the daily produced crude oil volume in barrels (42 U.S. gallons), depending upon the type of crude oil. It has been observed that greater losses occur with higher gravity crude oils.

It should be noted that daily crude oil production varies from well to well, from pool to pool, from field to field and by operator or producer to producer. Most states govern the daily allowance, or maximum amount of oil that can be produced by each individual well, the corresponding producer and the field or pool from which it is produced from underground. The volumes may range from less than 10 barrels of oil per day to many thousands of barrels of oil per day. Present day surface atmospheric oil storage tanks are designed to contain a certain specified volume of crude oil. The volume in each tank is related to the volume which a crude oil purchaser designates as a full load to be hauled away from the well site or tank battery in a mobile truck transport. This volume is typically in the 200 to 220 barrel range. Any additional storage tanks or space available left in a tank is just viewed as additional storage space.

It has been observed that the rate of vaporization due to changes in the atmospheric conditions was so high that, even though a particular well produced commercial quantities of crude oil into the stock tank, none remained to accumulate, or consequently be sold. Since crude oil has a natural vapor pressure that exceeds atmospheric pressure, crude oil is continually lost to the atmosphere. In addition, since PV=nRT, if one changes one of the parameters, the resulting volume changes. Because of the complex chemical nature of crude oils, their constituents and the physical changes they undergo when stored at atmospheric conditions, it becomes virtually impossible to predict the rate of vaporization at any given time or condition. Therefore, to prevent or reduce the volume lost, it becomes necessary to control all of the parameters of the equation $PV=nRT$ within the crude oil storage facilities.

The loss of crude oil to the atmosphere is directly related to the fashion in which it is stored. When liquid petroleum is placed in a closed container, the molecules entering the vapor phase cannot escape to the atmosphere, if the storage container is properly constructed to confine them. In random motion, many molecules strike the liquid and are recaptured. Thus, two processes occur simultaneously: vaporization (entry of particles into the vapor phase) and condensation (entry of particles into the liquid from the vapor phase). The rate of condensation increases as the number of particles in the vapor phase increases. The rate of condensation and the rate of evaporation are compared as a function of time. When the rates of these two processes become equal, the number of particles in the vapor phase becomes stabilized. This steady state, in which there is a balance between the dynamic processes of evaporation and condensation is termed "Dynamic Equilibrium". When equilibrium is reached, there is no further change in the number of particles in the vapor. Vaporization ceases. When the pressure exerted by the vapor is monitored, it is found to increase until equilibrium is reached and thereafter remains constant. It is also observed that the variation in vapor pressure with respect to temperature changes but if the vapor is confined, there is no loss. It is absolutely impossible for crude oil to ever reach dynamic equilibrium with the atmosphere, without loosing the majority of the crude oil to the atmosphere.

SUMMARY OF THE INVENTION

A liquid petroleum confinement system is provided in which at least two storage compartments are in valved vapor phase communication with each other. The two storage compartments are each separately connected to a crude oil source. The two storage compartments are closed to the atmosphere. During a capture phase of crude oil production, the crude oil is first directed to the first storage compartment which is in vapor phase communication with the second compartment. As the crude oil accumulates in the first compartment, a dynamic equilibrium between the oil and its overlaid vapor is obtained at a pressure greater than atmospheric pressure. This configuration permits the first storage compartment to remain at constant pressure while the volume of stored pressurized petroleum increases. When the first storage compartment becomes full, the first storage compartment is isolated from the petroleum source and the second storage compartment by diverting the crude petroleum source to the second storage compartment, closing the valve in the vapor line joining the two compartments and then relieving any excess pressure in the first storage compartment to the atmosphere before unloading the liquid stored in the first storage compartment to a tank truck for transport. Before the second storage compartment becomes full, the process is repeated by opening the valve in the vapor line joining the two compartments, but only after the first compartment has been emptied.

According to the present invention, a simply operated confinement system is provided for the collection, storage and distribution of pressurized petroleum.

Another object of the present invention is to provide a confinement system which maximizes the recovery of petroleum products from natural geological deposits.

A further object of the present invention is to teach a pressurized petroleum confinement system which minimizes the release of volatile petroleum components to the atmosphere during collection of the petroleum from underground sources.

A still further object of the present invention is to enable the producer to provide the most economically valuable petroleum product to the buyer.

These and further objects of the present invention will become readily apparent from the following specification and figures.

DETAILED DESCRIPTION OF THE INVENTION

Figure 1:
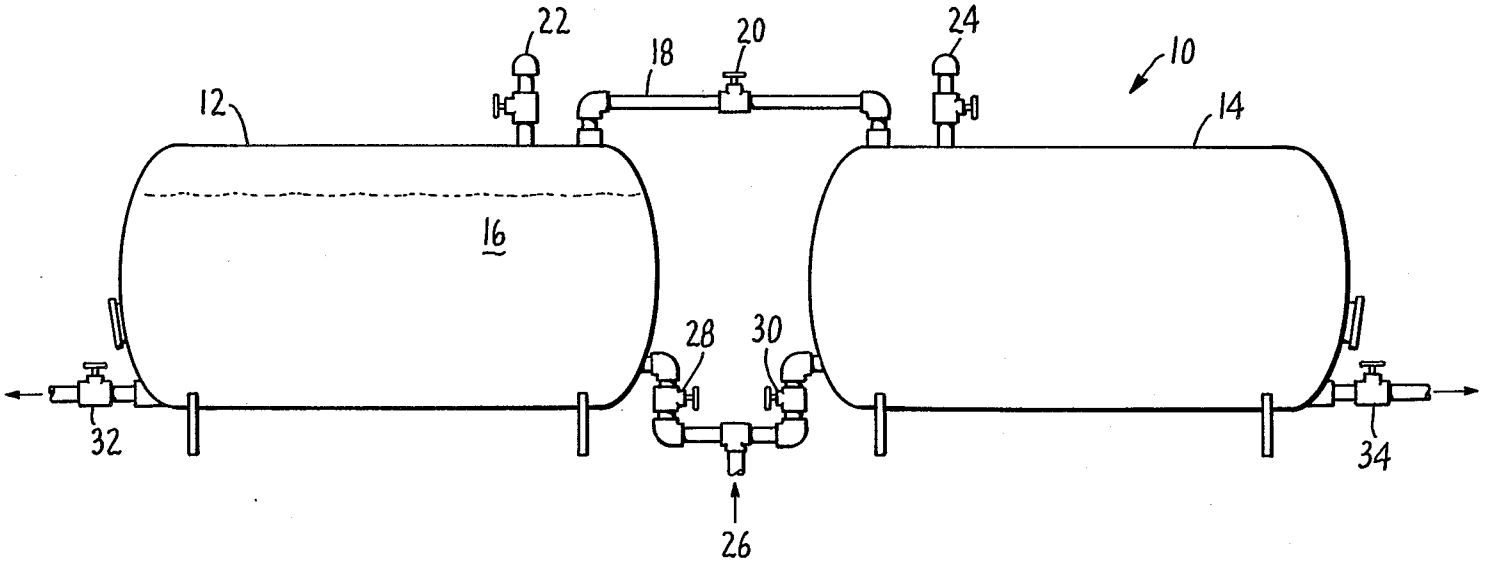
FIG. 1 is an elevational view of two storage tanks which are configured to practice the present invention.

The components of the pressurized petroleum confinement system 10 are shown in FIG. 1. A first storage tank 12 is constructed of steel to act as a pressure vessel. A second storage tank 14 is also provided having the same construction as first storage tank 12 and having identical storage volume. While this symmetry is not critical to the present invention, the preferred embodiment utilizes identical first and second storage tanks. As shown in FIG. 1, liquid petroleum 16 is present in first storage tank 12 and the remainder of the space is overlaid with petroleum vapor phase. At the top of each tank is a valved vapor connecting line 18 which connects first storage tank 12 to second storage tank 14 through vapor control valve 20.

First storage tank 12 is also equipped with first storage tank pressure relief valve 22 which is set to prevent pressure inside tank 12 from exceeding its maximum design operating pressure. Similarly, second storage tank 14 is equipped with second storage tank pressure relief valve 24. In a particularly preferred embodiment, first storage tank pressure relief valve 22 would not vent directly to the atmosphere as shown in FIG. 1, but instead would be directed into second storage tank I4 which would presumably be empty during the filling of first storage tank 12. See below for a more complete explanation of the sequence of loading, storing and unloading. Similarly, second storage tank pressure relief valve 24 would be connected directly to first storage tank 12.

Connected to the bottom of first storage tank 12 and second storage tank 14 is a petroleum source manifold 26. A first storage tank liquid valve 28 and a second storage tank liquid valve 30 are provided to direct liquid into first storage tank 12 or second storage tank 14 or both.

Also connected to the bottom of first storage tank 12 and second storage tank 14 are first storage tank transfer valve 32 and second storage tank transfer valve 34 which are used to distribute stored petroleum to tank trucks or pipeline facilities.

According to the method of the present invention, when pressurized petroleum is being collected for storage in first storage tank 12, the following valves are closed: second storage tank liquid valve 30, first storage tank transfer valve 32, and second storage tank transfer valve 34 . Vapor control valve 20 is open to permit vapor communication between and second storage tank 14 first storage tank 12. Liquid petroleum is added to first storage tank 12 until it is nearly filled with liquid, as is shown for example, in FIG. 1.

At the time that the first storage tank 12 is full, it is isolated from second storage tank 14 by closing vapor control valve 20 and first storage tank liquid valve 28. At this time, second storage tank liquid valve 30 is opened to permit liquid petroleum flow into second storage tank 14. In the meantime, first storage tank 12 is relieved of any excess vapor pressure above atmospheric pressure. Thereafter the first storage tank 12 is ready for unloading to a waiting tank truck or pipeline through first storage tank transfer valve 32.

While filling second storage tank 14 to its capacity, the same procedure can be followed assuming that the first storage tank 12 has been emptied as described above. In this phase of confinement procedure, the following valves will be closed: first storage tank liquid valve 28, first storage tank transfer valve 32 and second storage tank transfer valve 34. Again, vapor control valve 20 will be open to permit vapor phase equilibrium between second storage tank 14 and first storage tank 12. Second storage tank liquid valve 30 is open to permit liquid to enter through the petroleum source manifold 26.

In the preferred embodiment of the present invention, each storage tank is equipped with a vertical sight glass position in front of a measure board to approximate the daily produced volumes and to determine when the tank is full. At the time of off loading of the tanks to a truck transport or a pipeline facility, the exact volume of the tank is measured by removing a thief hatch, gauging the tank with an API plumb bob gauge line and gauge the remaining volume in the tank after the petroleum has been removed. Once the off loading has been completed, the thief hatch is replaced and the tank is secured into pressure-confinement mode.

It is also to be recognized by those of ordinary skill in the art that while the present invention has been described with reference to two storage tanks, it is possible to gang together a plurality of tanks each interconnected to each other with valved vapor and liquid pathways to permit dynamic equilibrium to be obtained inside the storage tank, at a pressure in excess of atmospheric. Further, it is intended that the present invention also cover the situation wherein a single storage tank is partitioned into two separate compartments.

We claim:

1. A method for collecting and maintaining oil containing pressurized components and thereafter distributing oil in equilibrium with atmospheric conditions which comprises:

a. providing a pair of storage tanks, each having an oil inlet below the top of the tank and a valved gas outlet at the top of the tank and a valved line connecting the tops of the two tanks;

b. passing oil containing pressurized gas through the oil inlet of the first of said tanks until the tank is nearly full of liquid oil and the oil is overlaid with pressurized gas filling the remainder of the tank;

c. opening said valved line to permit flow of gas from said first tank to the empty second tank of said pair of tanks until pressure in the two tanks is equalized and then closing said valved line;

d. ceasing passage of oil into said first tank and directing the oil into said second tank;

e. opening the gas outlet valve of said first tank to equalize tank pressure with atmospheric pressure;

f. withdrawing oil from said first tank until the tank is substantially empty; and g. repeating steps (b) to (f) starting with the filled second tank.

* * * * *